US011013949B2

(12) United States Patent
Hockridge

(10) Patent No.: US 11,013,949 B2
(45) Date of Patent: May 25, 2021

(54) ADJUSTABLE POSITION GRIPPING HANDLE ASSEMBLY FOR EXERCISE MACHINES

(71) Applicant: HOIST FITNESS SYSTEMS, INC., Poway, CA (US)

(72) Inventor: Bruce Hockridge, San Diego, CA (US)

(73) Assignee: HOIST FITNESS SYSTEMS, INC., Poway, CA (US)

( * ) Notice: Subject to any disclaimer, the term of this patent is extended or adjusted under 35 U.S.C. 154(b) by 134 days.

(21) Appl. No.: 16/567,555

(22) Filed: Sep. 11, 2019

(65) Prior Publication Data

US 2020/0121979 A1 Apr. 23, 2020

Related U.S. Application Data

(60) Provisional application No. 62/747,015, filed on Oct. 17, 2018.

(51) Int. Cl.

| | |
|---|---|
| ***A63B 21/00*** | (2006.01) |
| ***A63B 23/035*** | (2006.01) |
| ***A63B 23/12*** | (2006.01) |

(52) U.S. Cl.

CPC ..... *A63B 21/4035* (2015.10); *A63B 21/4047* (2015.10); *A63B 23/03533* (2013.01); *A63B 23/1254* (2013.01); *A63B 2225/09* (2013.01)

(58) Field of Classification Search

CPC ..... A63B 21/00058; A63B 21/00069; A63B 21/00072; A63B 21/00076; A63B 21/0615; A63B 21/15; A63B 21/159; A63B 21/4027; A63B 21/4033; A63B 21/4035; A63B 21/4047; A63B 21/4049; A63B 23/035; A63B 23/03516; A63B 23/03533;

(Continued)

(56) References Cited

U.S. PATENT DOCUMENTS 4,203,591 A * 5/1980 Gibson ..... A63B 21/012 482/46
4,772,015 A * 9/1988 Carlson ..... A63B 23/12 482/902

(Continued)

OTHER PUBLICATIONS

International Searching Authority, International Search Report and Written Opinion for corresponding International Application No. PCT/US2019/050599, dated Dec. 4, 2019, 9 pages.

*Primary Examiner* — Gary D Urbiel Goldner
(74) *Attorney, Agent, or Firm* — David R. Heckadon; Gordon Rees Scully Mansukhani LLP

(57) ABSTRACT

A gripping handle assembly for an exercise machine, the gripping handle assembly having an axial shaft connected at an angle to a gripping handle, wherein the axial shaft is receivable into a circular bearing housing that is mounted to an end of an exercise arm, and wherein the axial shaft and the circular bearing housing each have engaging mechanisms such that a user pushes on a knob or pulls on the gripping handle to first unlock the axial shaft and then rotate the gripping handle. Releasing the gripping handle causes a spring to lock it into its new radial position. A first engaging mechanism may be a collar connected to the gripping handle with an indexing tab on the collar and a second engaging mechanism may be a plurality of indexing slots on the circular bearing housing with the indexing tab receivable therein.

10 Claims, 13 Drawing Sheets

(58) Field of Classification Search
CPC ..... A63B 23/03541; A63B 23/12; A63B 23/1245; A63B 23/1254; A63B 23/1263; A63B 2225/09; A63B 2244/09
See application file for complete search history.

(56) References Cited

U.S. PATENT DOCUMENTS

| | | | | |
|---|---|---|---|---|
| 5,445,581 | A * | 8/1995 | Ferber | A63B 21/015 482/115 |
| 5,536,223 | A * | 7/1996 | Ferber | A63B 21/015 482/115 |
| 5,820,521 | A * | 10/1998 | Edwards | A63B 21/4049 482/44 |
| 5,971,895 | A | 10/1999 | Habing | |
| 6,394,937 | B1 | 5/2002 | Voris | |
| 6,579,213 | B1 * | 6/2003 | Webber | A63B 21/155 482/100 |
| 7,597,655 | B2 | 10/2009 | Webber et al. | |
| 7,641,602 | B2 | 1/2010 | Rogers et al. | |
| 9,248,334 | B2 * | 2/2016 | Dupuis | A63B 21/15 |
| 9,586,081 | B2 | 3/2017 | Lagree et al. | |
| 9,604,086 | B2 | 3/2017 | Meredith et al. | |
| 9,999,797 | B2 | 6/2018 | Meredith et al. | |
| 10,843,031 | B1 * | 11/2020 | Anne | A63B 21/4035 |
| 2003/0134726 | A1 * | 7/2003 | Yu | A63B 21/4047 482/110 |
| 2006/0252612 | A1 | 11/2006 | Melcer | |
| 2014/0087925 | A1 * | 3/2014 | Dupuis | A63B 23/1236 482/97 |
| 2015/0258368 | A1 * | 9/2015 | Turnbow | A63B 23/03533 482/117 |
| 2015/0367166 | A1 * | 12/2015 | Lagree | A63B 21/15 482/123 |
| 2016/0256733 | A1 * | 9/2016 | Lagree | A63B 22/0087 |
| 2017/0136286 | A1 * | 5/2017 | Lewis | A63B 21/00069 |
| 2018/0111020 | A1 * | 4/2018 | Lagree | A63B 23/0429 |
| 2018/0345064 | A1 * | 12/2018 | Aronson | A63B 21/025 |

* cited by examiner

ADJUSTABLE POSITION GRIPPING HANDLE ASSEMBLY FOR EXERCISE MACHINES

RELATED APPLICATION

The present application claims priority to U.S. Provisional Patent Application Ser. No. 62/747,015, entitled Adjustable Position Mounted Handle, filed Oct. 17, 2018, the entire disclosure of which is incorporated herein by reference in its entirety for all purposes.

TECHNICAL FIELD

The present system relates to gripping handle assemblies for exercise machines.

BACKGROUND OF THE INVENTION

Different exercise machines require their users to grasp handles when either pressing or pulling on an exercise arm. Examples of such "pressing" exercise machines include machines such as chest press machines and shoulder press machines. Examples of such "pulling" machines include lateral pulldown machines and mid-row pull back machines. Different hand angles and positions are required to operate these different machines. In addition, it is often desired to use a variety of different hand grip positions when operating each one of these machines. This is because switching the hand positioning requires more muscle engagement from the targeted muscle groups which means more benefits for the user.

Unfortunately, changing hand grip positions on most exercise machines is a cumbersome process. This is because existing exercise machines that provide multiple gripping positions for the hand grips do so by fixedly mounting the different gripping handles into various positions on the ends of the exercise arms. As such, a user has multiple gripping positions to choose from, but also has to deal with problems of added weight and added clutter to be able to remove and change each gripping handle. It would therefore instead be desirable if multiple gripping handle positions could be offered in an alternate, comfortable and easy to use manner. It would also be especially desirable to provide a system in which a user can quickly change the gripping angle position (and quickly lock it into the new position) without running the risk that the gripping handle will unlock and unexpectedly rotate or move.

SUMMARY OF THE INVENTION

The present system provides a novel gripping handle for an exercise machine that can easily be rotated and moved into a variety of different locked positions. In preferred aspects, these different positions are disposed at radial angles to one another around a central axis.

In one preferred aspect, the present system provides a gripping handle assembly for an exercise machine, comprising: a circular bearing housing; an axial shaft receivable into the circular bearing housing; a gripping arm extending from the axial shaft, the gripping arm extending at an angle to the axial shaft; a plurality of bearings between the axial shaft and the circular bearing housing permitting rotational movement of the axial shaft within the circular bearing housing; a first engaging mechanism on the axial shaft; a second engaging mechanism on the circular bearing housing, wherein the first and second engaging mechanisms interlock to prevent rotation of the axial shaft in the circular bearing housing and wherein the first and second engaging mechanisms detach to permit rotation of the axial shaft in the circular bearing housing; and a spring biasing element in the circular bearing housing, the spring biasing element biasing the axial shaft into a locked position, the spring being displaceable to move the axial shaft into an unlocked position. As such, the gripping handle can easily be rotated into multiple positions on an exercise arm on an exercise machine.

In various preferred aspects, the axial shaft moves forward into the locked position when the spring is in its neutral position. As such, the user must compress (or in alternate designs, extend) the spring to unlock the gripping handle. As such, the natural position of the gripping handle is to be locked into position. This is much safer than relying upon the user to perform a positive procedure to lock the gripping handle position. Moreover, the handle assembly may be mounted onto a shoulder press machine such that a user pushing upwards on the arm also urges the axial shaft into its locked position.

In preferred embodiments, the first engagement mechanism may be a collar wrapping around the outside of the circular housing having an indexing tab thereon, and the second engagement mechanism may be a plurality of indexing slots on an indexing plate on the circular bearing housing, with the indexing tab receivable into any one of these indexing slots. The various indexing slots may define a plurality of different radial positions 45 degrees apart from one another around a circle. Once the indexing tab on the handle assembly is seated into the slot of the mounted indexing plate the handle will no longer rotate and will stay in that desired position. Spring compression (or in alternative embodiments, spring expansion) is preferably used to keep the tab on the handle assembly mated into the slot in the indexing plate. By compressing the spring, the indexing tab portion of the handle assembly can be withdrawn (i.e.: pushed back) from the indexing plate so the handle assembly can be rotated to an alternate slot in the indexing plate. Releasing the compression on this spring results in the handle assembly snapping back into a locked position.

In the present system, one or both of a pair of handles can be independently rotated into multiple gripping positions. This eliminates the extra weight and clutter of instead requiring more than one interchangeable handle for each gripping position. In addition, the present adjustable handle can advantageously provide handle positioning that wouldn't be possible with a series of different fixed mounted handles. For example, the present handles can be rotated to provide close gripping or farther apart gripping positions on a seated chest press machine or a seated shoulder press machine. Yet another advantage of the present system is that the two handles can be positioned such that they do not physically interfere with each other.

DETAILED DESCRIPTION OF INVENTION

Figure 1A:
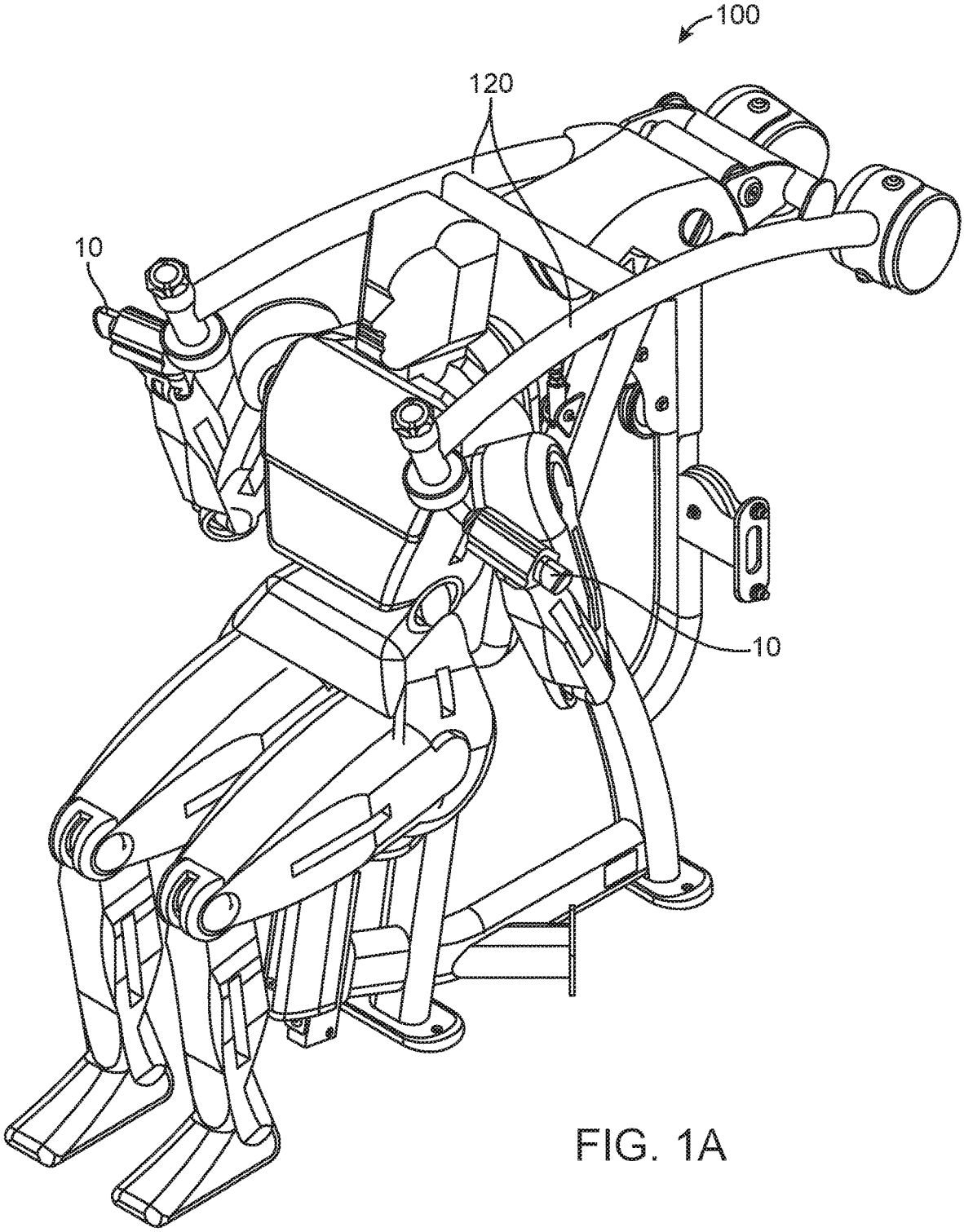
FIG. 1A is a front perspective view of a shoulder press exercise machine with the present gripping handles in a first position at the start of the exercise.
Figure 1B:
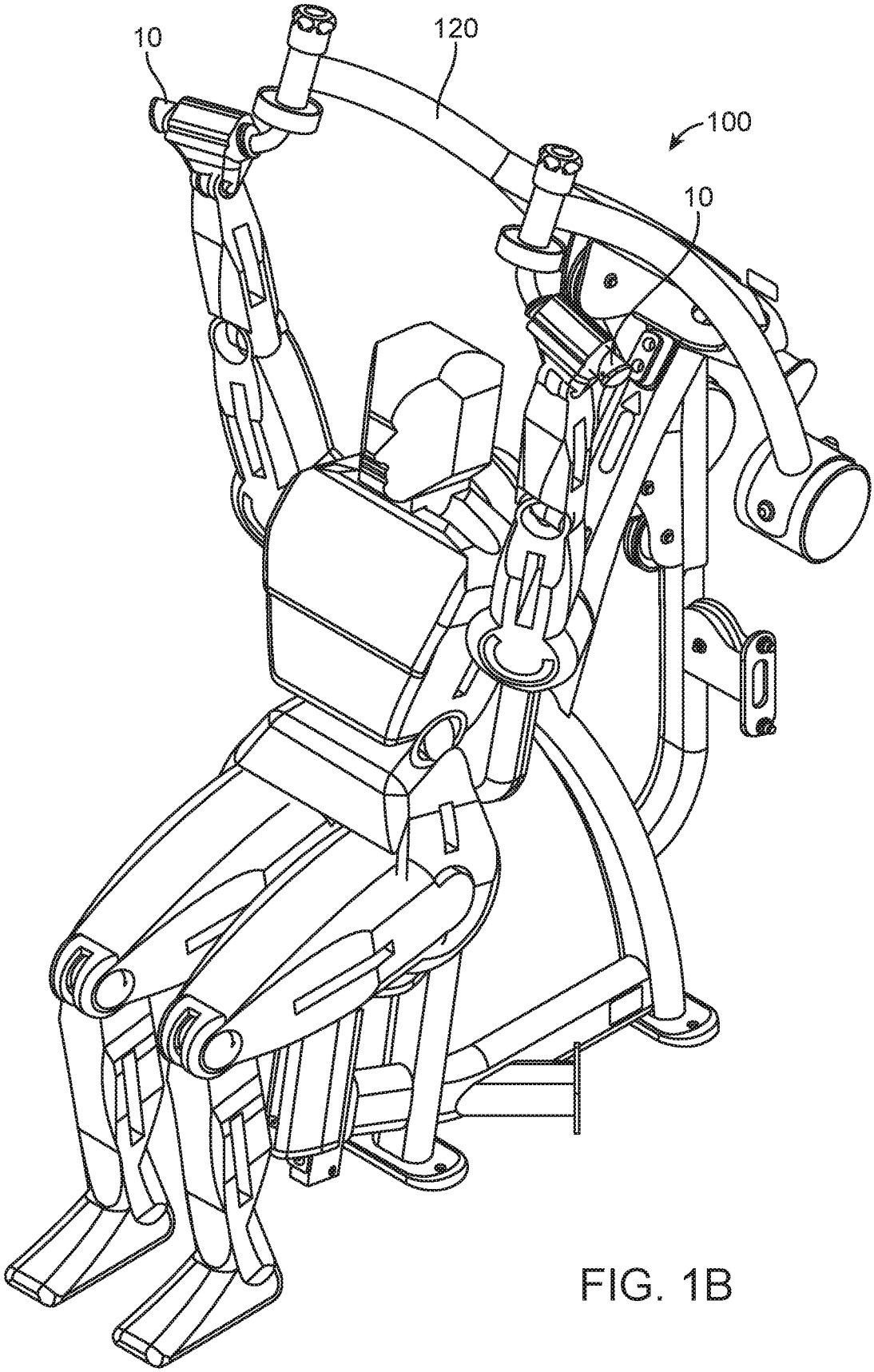
FIG. 1B is a front perspective view corresponding to FIG. 1A, but at the end of the shoulder press exercise.
Figure 2:
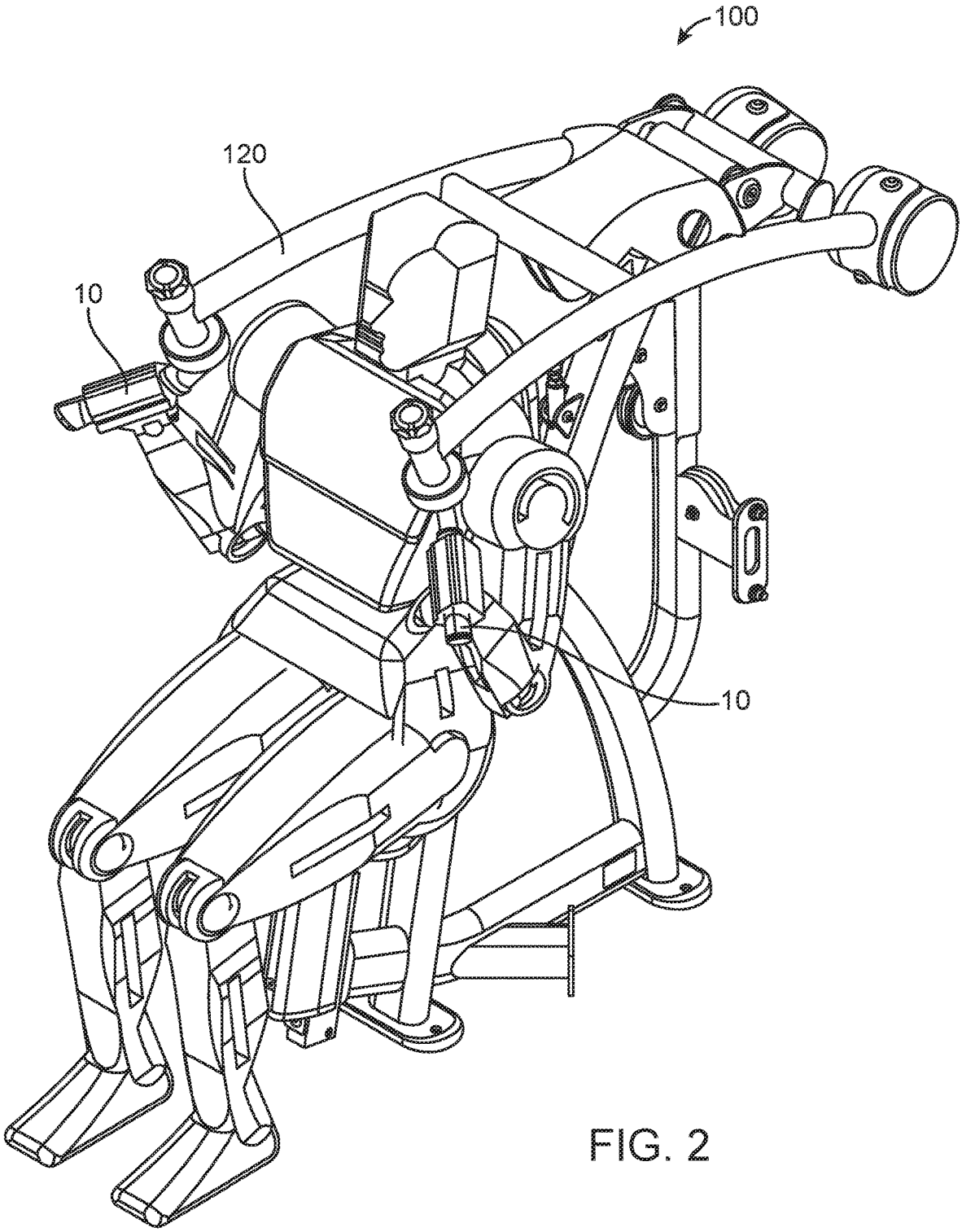
FIG. 2 is a front perspective view of a shoulder press exercise machine with the present gripping handles in a second position.
Figure 3:
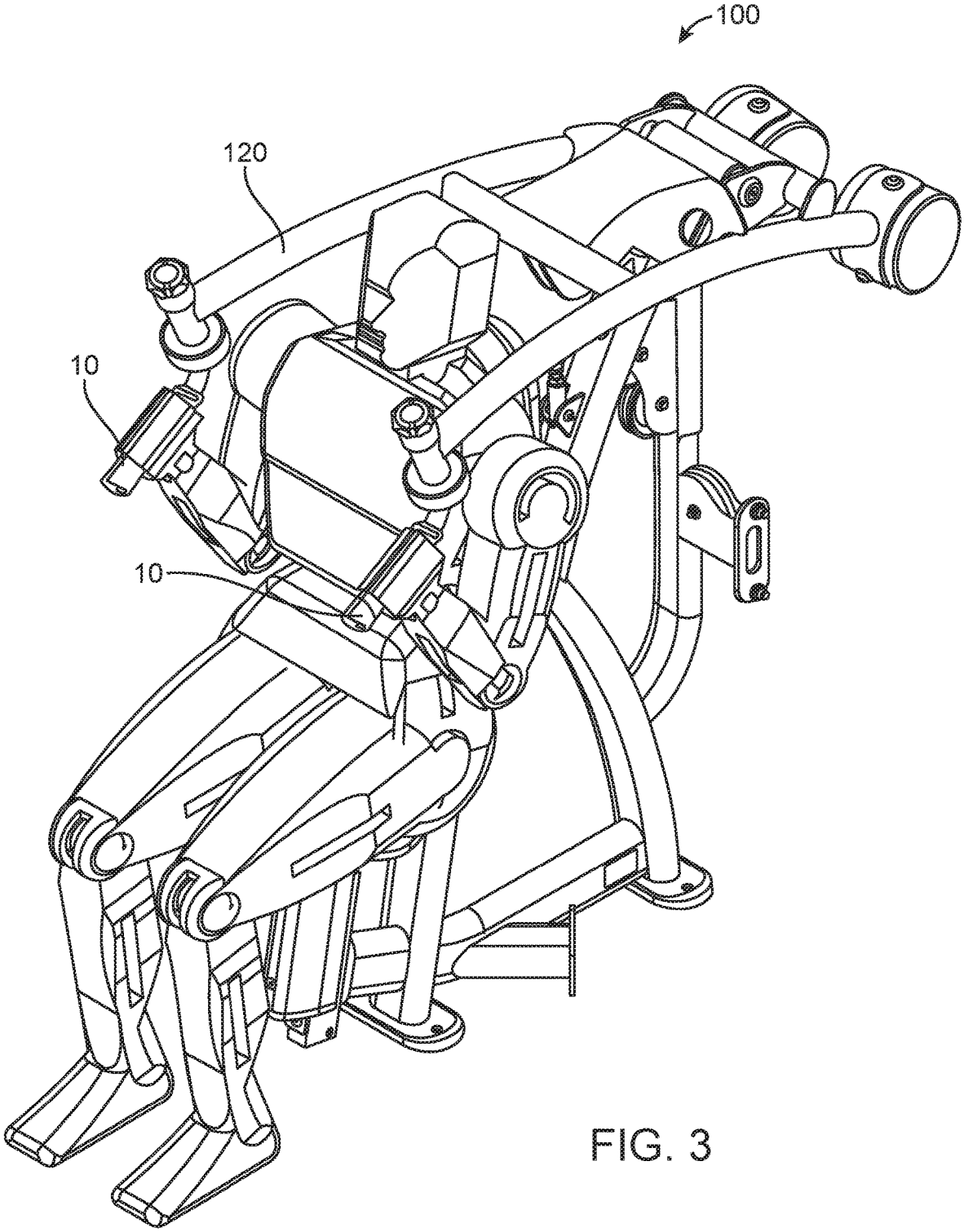
FIG. 3 is a front perspective view of a shoulder press exercise machine with the present gripping handles in a third position.
Figure 4:
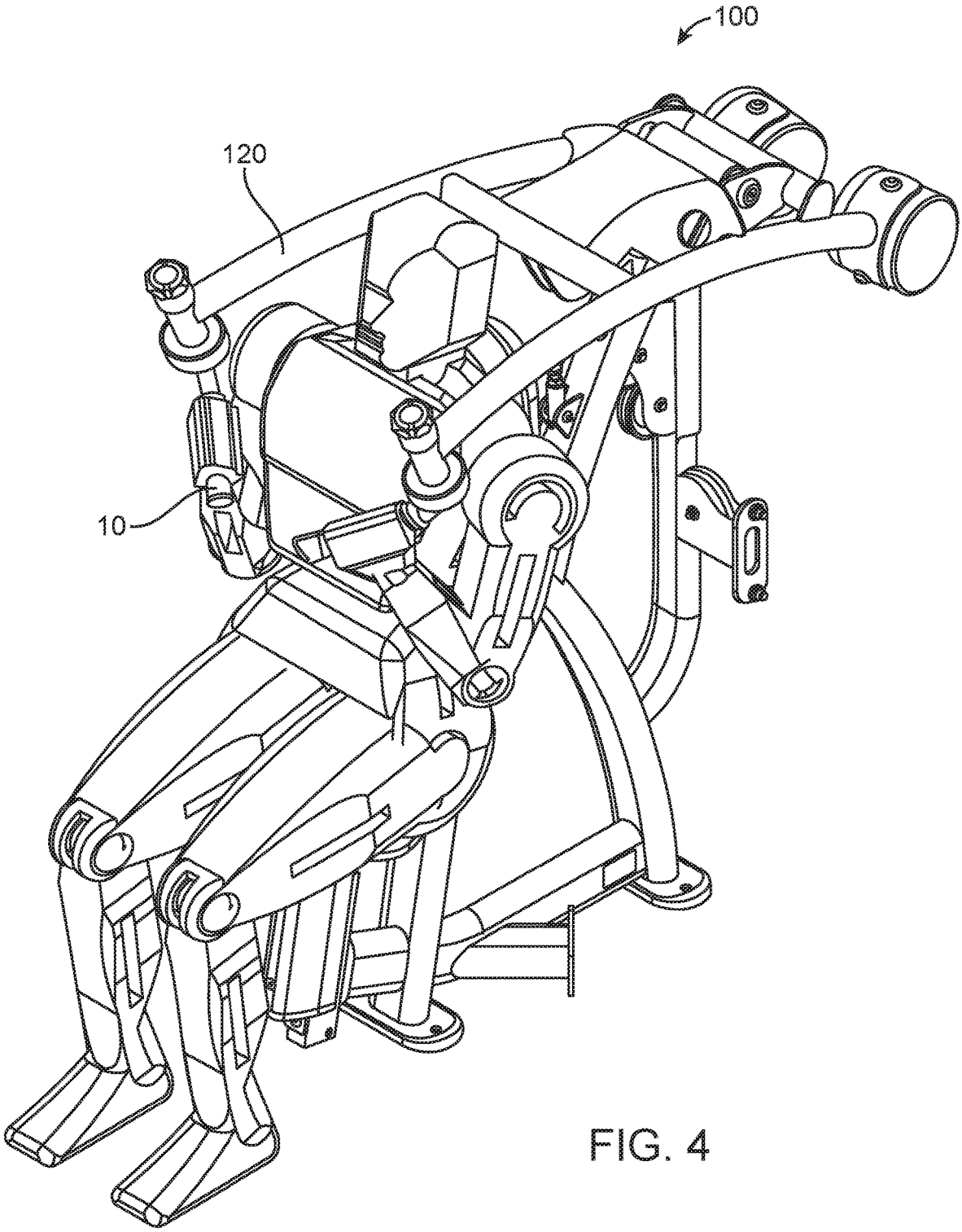
FIG. 4 is a front perspective view of a shoulder press exercise machine with the present gripping handles in a fourth position.
Figure 5:
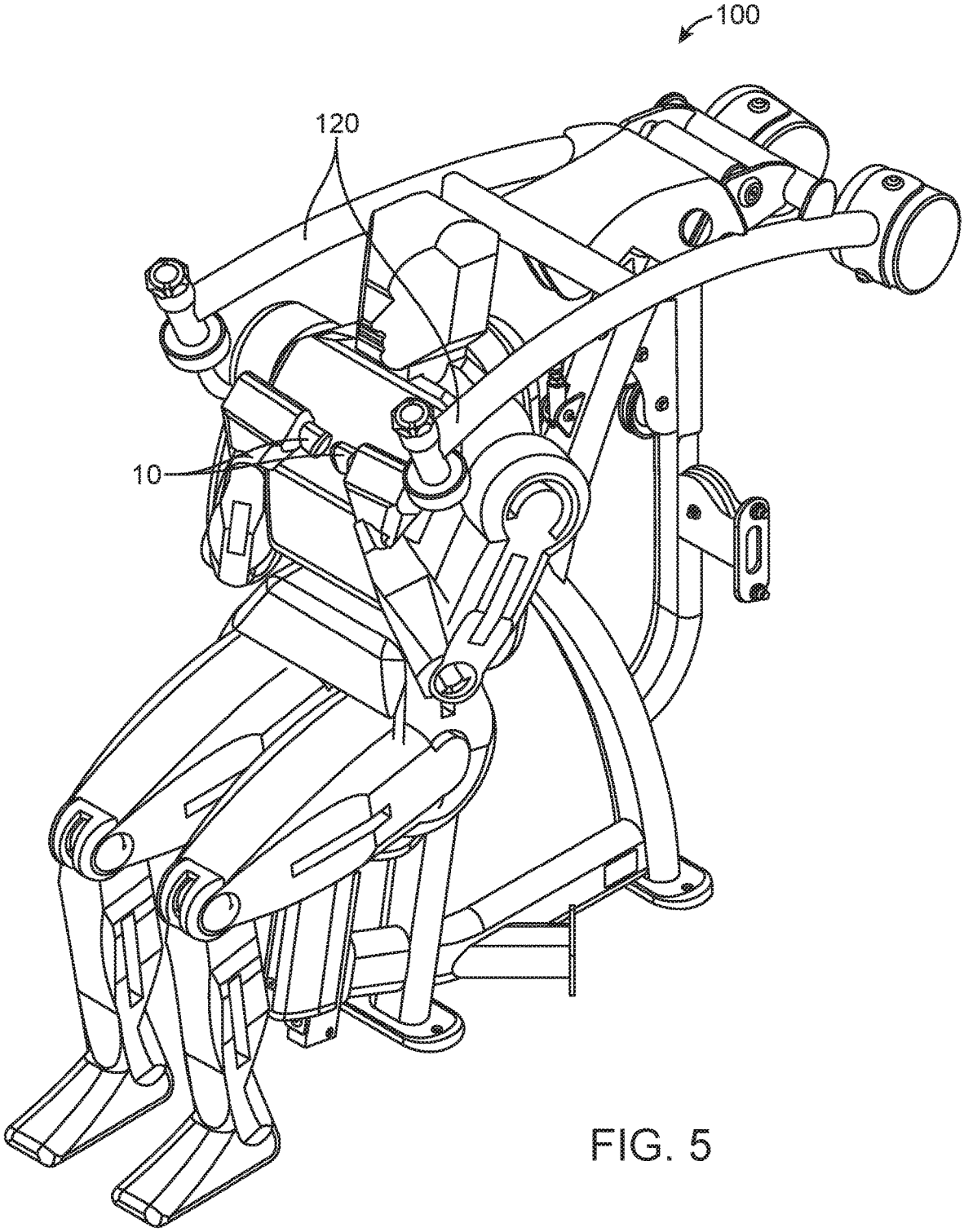
FIG. 5 is a front perspective view of a shoulder press exercise machine with the present gripping handles in a fifth position.

FIG. 1A is a front perspective view of a shoulder press exercise machine 100 with the present gripping handles 10 in a first position at the start of the exercise. FIG. 1B shows the same machine after the user has fully lifted the machine's exercise arms 120. In accordance with the present invention, a system for conveniently and easily re-positioning gripping handles 10 is provided. As such, the user can move the gripping handle 10 by 45 degrees (from the position in FIGS. 1A and 1B to the position shown in FIG. 2), or by 90 degrees (from the position in FIGS. 1A and 1B to the position shown in FIG. 3), or by 135 degrees (from the position in FIGS. 1A and 1B to the position shown in FIG. 4), or by 180 degrees (from the position in FIGS. 1A and 1B to the position shown in FIG. 5). As can be appreciated, the present system's ability to rotate gripping handles 10 to various illustrated positions gives the user the ability to perform shoulder press exercises with their hands disposed at different angles. This has the benefit of working different muscle groups.

Importantly, it is to be understood that the present gripping handle assembly is not limited to use only with shoulder press machines. Rather, the present gripping handle assembly can be used with any exercise machine where moveable and re-positionable gripping handles are desired. For example, the present gripping handle assembly can be used with other machines, including but not limited to other "pushing" machines including chest press machines or "pulling" machines such as lateral pulldown machines or mid-row pull back machines.

Figure 6:
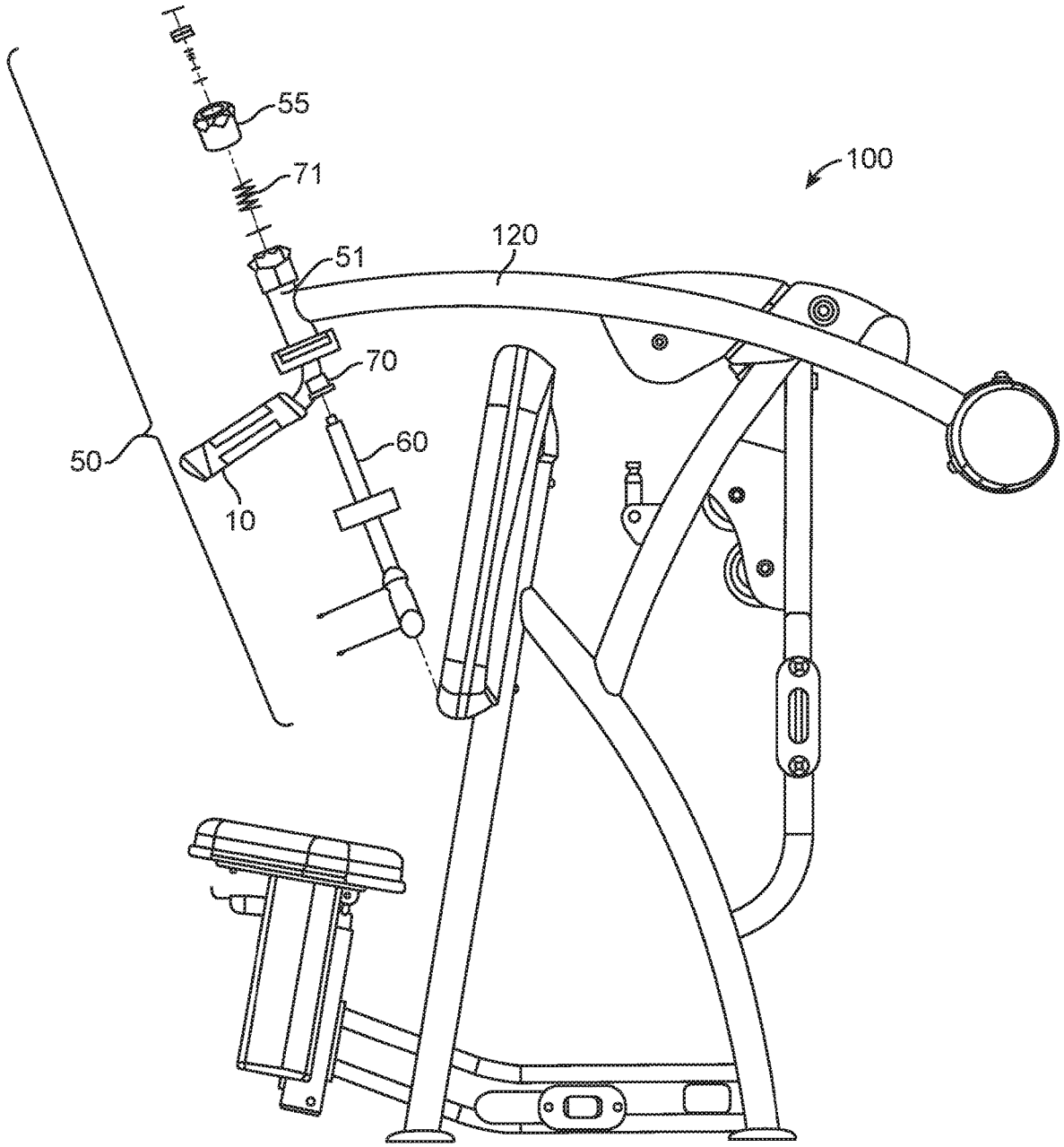
FIG. 6 is a side elevation view of the shoulder press exercise machine with one of the present gripping handle assemblies shown in exploded view.
Figure 7:
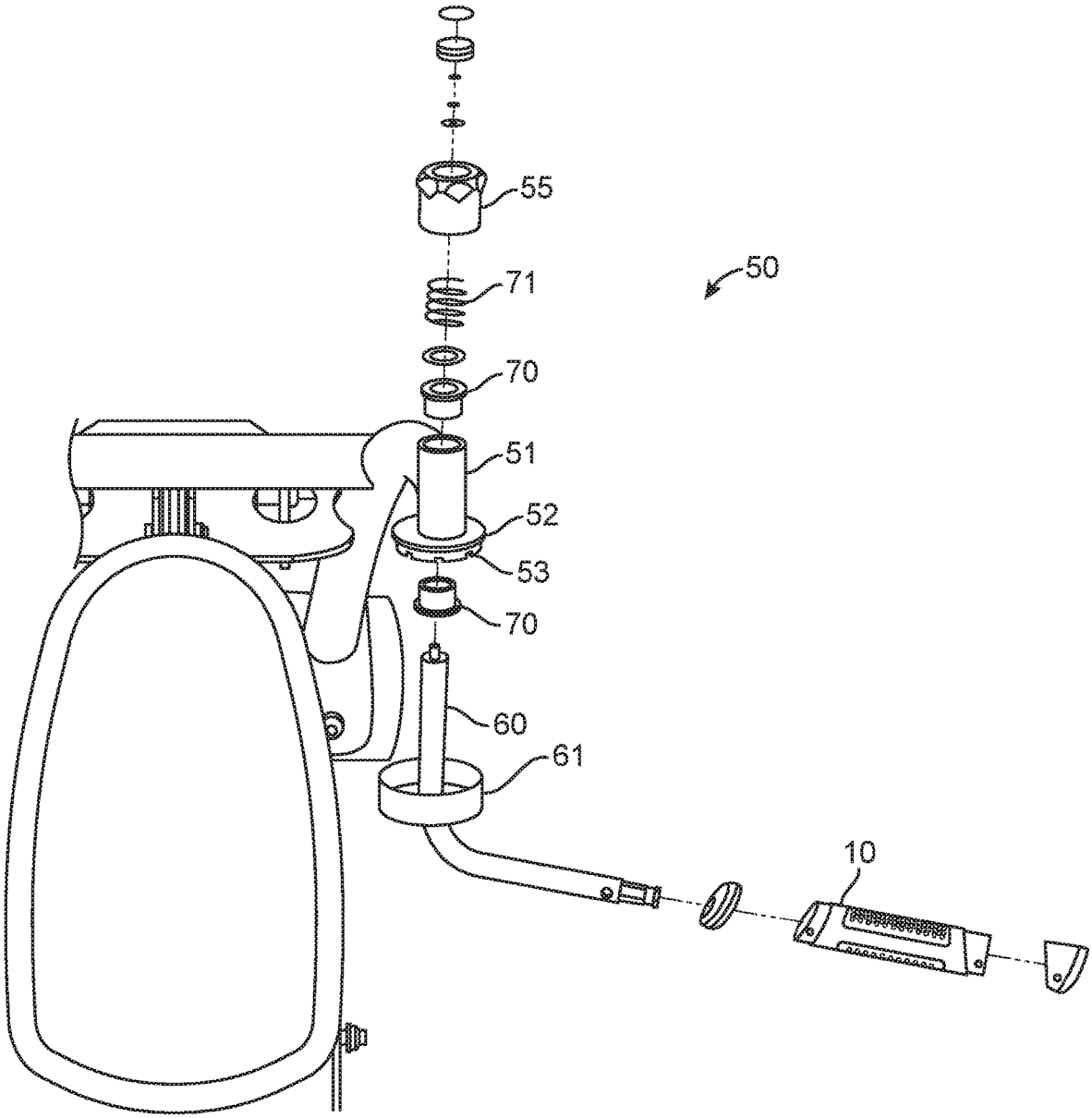
FIG. 7 is a close up front exploded view of one of the gripping handle assemblies shown in exploded view.

FIG. 6 is a side elevation view of shoulder press exercise machine 100 with one of the present gripping handle assemblies shown in exploded view. FIG. 7 is a close up view of one of the gripping handle assemblies shown in exploded view, as follows.

Gripping handle assembly 50 comprises a circular bearing housing 51 and an axial shaft 60 receivable into circular bearing housing 51. A gripping arm 10 extends outwardly at an angle from axial shaft 60; and one or more bearings 70 are received between axial shaft 60 and circular bearing housing 51. Bearings 70 permit rotational movement of axial shaft 60 within circular bearing housing 50. A knob 55 is also provided.

Gripping handle 10 is locked into place as follows. A first engaging mechanism 61 is provided on axial shaft 60 and a second engaging mechanism 52 is provided on circular bearing housing 50. The first and second engaging mechanisms 61 and 52 interlock to prevent rotation of the axial shaft 60 in circular bearing housing 50. The first and second engaging mechanisms 61 and 52 can be detached (i.e.: unlocked) to permit rotation of axial shaft 60 in the circular bearing housing 50. However, a spring biasing element 71 in circular bearing housing 51 can be used to bias axial shaft 60 into its locked position. Only when the spring 71 is displaced (i.e.: compressed) does axial shaft 60 become moveable into an unlocked position.

As illustrated herein, spring 71 may be compressed from its neutral position to unlock the gripping handle and permit its rotation. Preferably, this is done by pushing down on knob 55 (and/or pulling on handle 10). However, it is to be understood that the present system also encompasses embodiments where the spring is instead extended from its neutral position to unlock the gripping handle and permit its rotation. As illustrated herein, however, axial shaft 60 moves forward into its locked position when the spring returns to its neutral position.

Figure 8B:
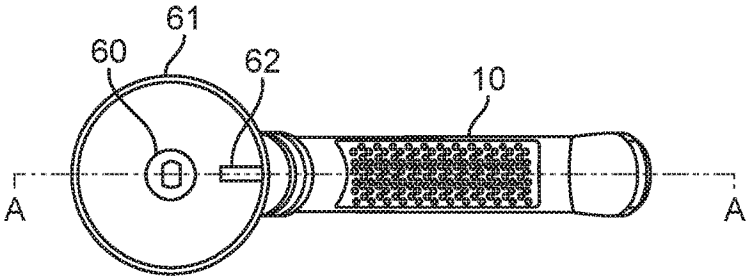
FIG. 8B is a front elevation view of the gripping handle.
Figure 8C:
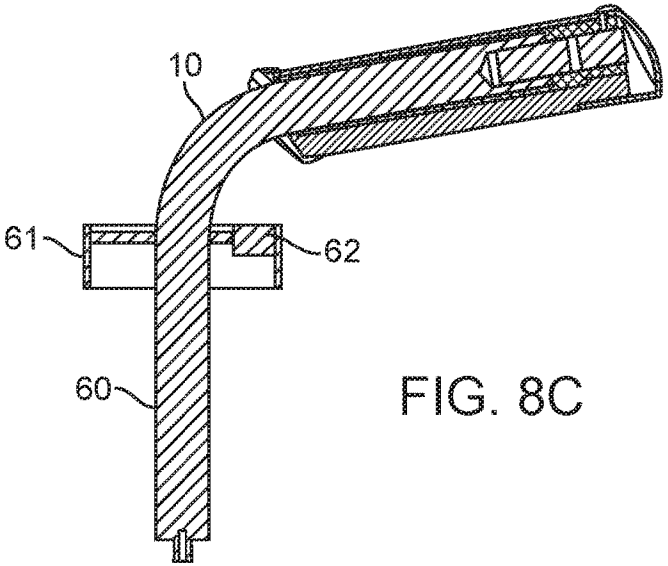
FIG. 8C is a sectional side view of the gripping handle.
Figure 8A:
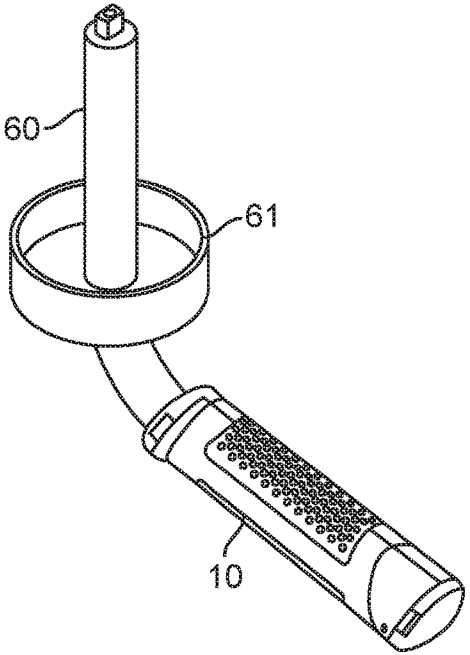
FIG. 8A is a perspective view of the gripping handle of the gripping handle assembly.
Figure 9:
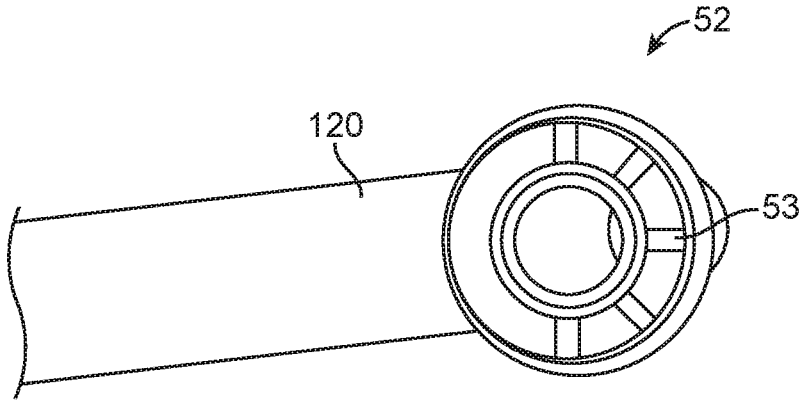
FIG. 9 is a close-up perspective end view of the collar and indexing plate slots at the end of the exercise arm of the shoulder press exercise machine.

In preferred aspects best seen in FIGS. 8A to 8C, the present gripping handle assembly can be locked and unlocked with its first engagement mechanism 61 being a collar having an indexing tab 62 thereon. Preferably, to provide protection to the user's fingers, collar 61 wraps around the outside of circular bearing housing 51. The second engagement mechanism 52 as best seen in FIG. 9 may optionally be a plurality of indexing slots 53 on the end of an indexing plate 52. The indexing tab 62 is receivable into any one of the indexing slots 53 in plate 52.

Figure 10A:
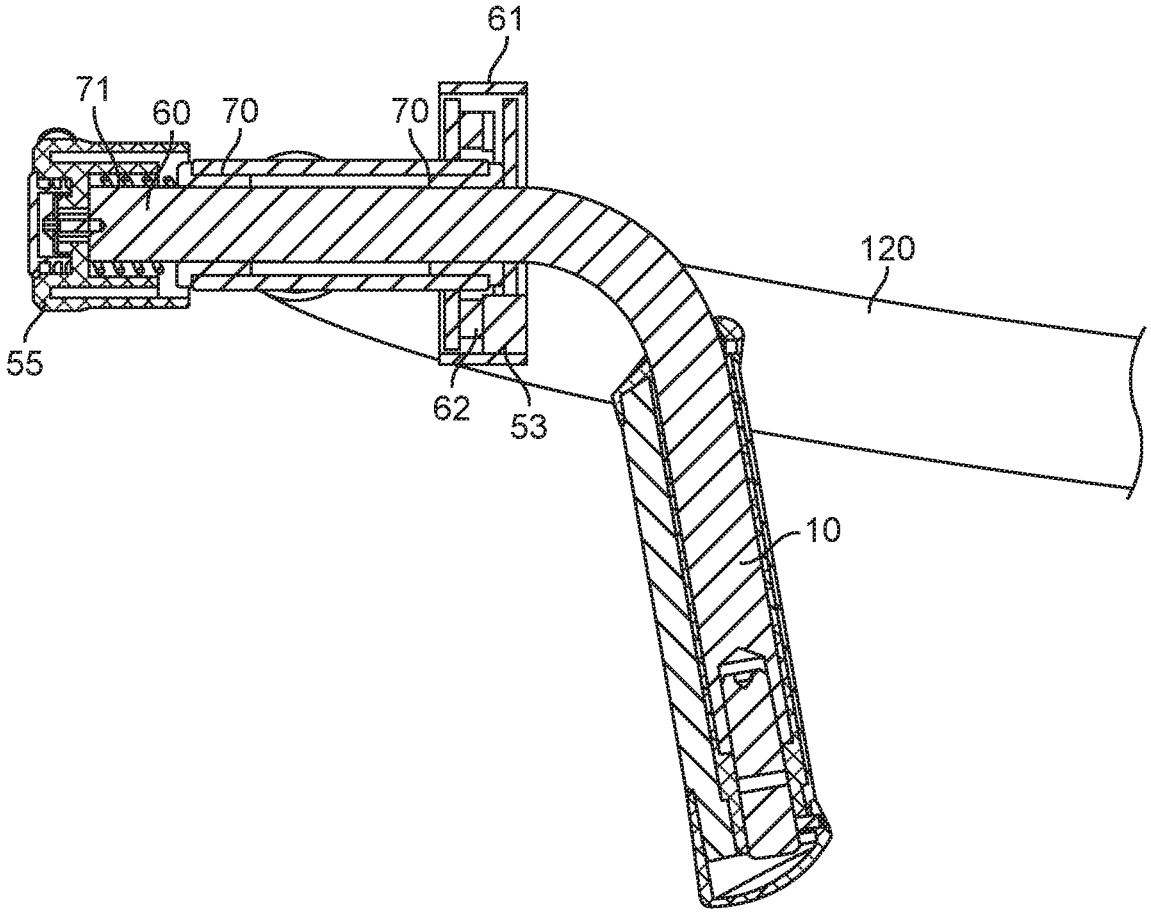
FIG. 10A is a sectional side elevation view of the present gripping handle assembly with the gripping handle in a locked position.
Figure 10B:
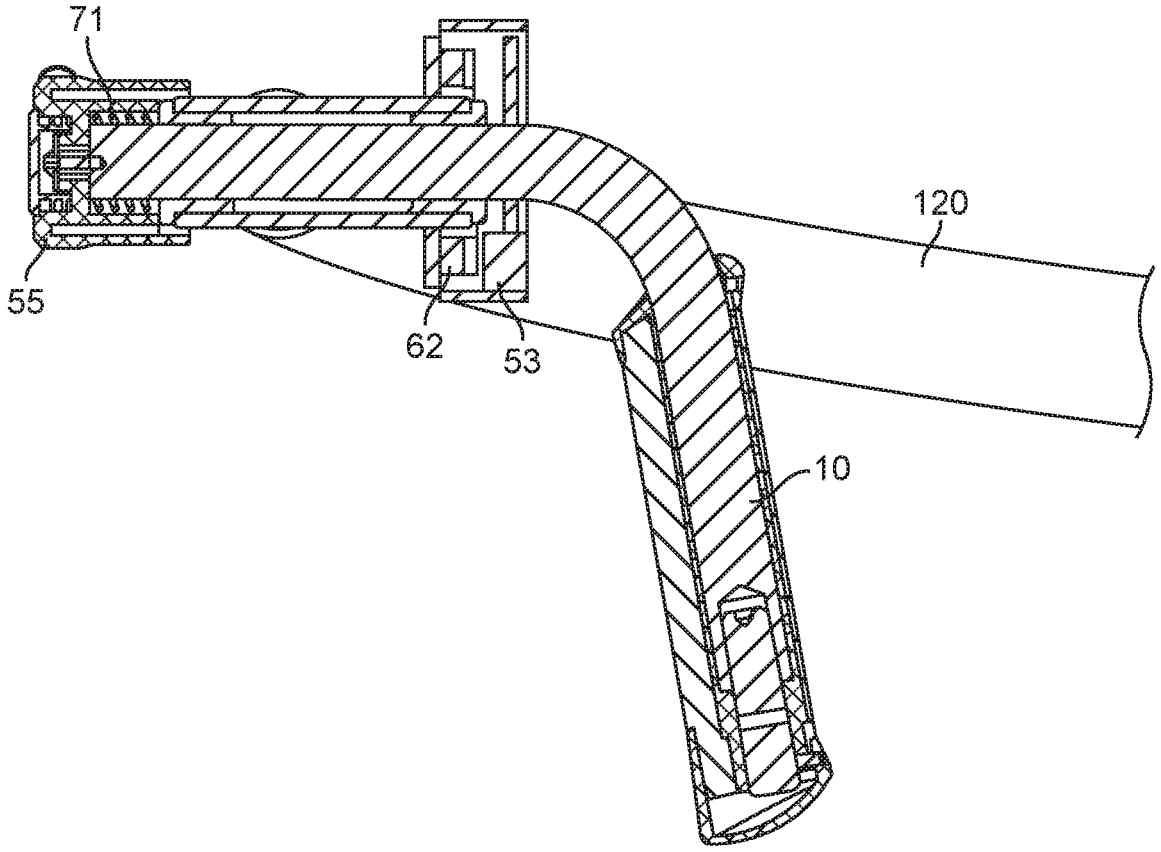
FIG. 10B is a sectional side elevation view of the present gripping handle assembly with the gripping handle in an unlocked position.

In operation, the first and second engaging mechanisms 61 and 52 (illustrated herein as tab 62 and indexing slots 53 in plate 52) detach from one another when a user pushes down on knob 55 and/or pulls gripping arm 10 downwardly in a direction partially out of circular bearing housing 50. Further details of this locking and unlocking are seen by comparing FIGS. 10A and 10B, as follows. As seen in FIG. 10A, the gripping handle 10 is in a locked position with indexing tab 62 received into one of slots 53. Next, as seen in FIG. 10B, the user pulls on knob 55 and/or pushes gripping handle 10 in an axial direction (i.e.: compressing spring 71) to unlock indexing tab 62 from slot 53. (Knob 55 and handle 10 are connected and move together as a unit). At this time, gripping handle 10 can be rotated about the central axis of axial slot 60 to align indexing tab 62 with another one of indexing slots 53. When knob 55 and gripping handle 10 are then released, spring 71 will expand back into its neutral position, thereby locking indexing tab 62 into indexing slot 53. As such, the user must continuously pull back (and hold back) on the hand grip to unlock and adjust its angular position. This makes the present system ideally suited for exercise machines in which the user is pushing forwardly on the hand grip—since such forward pressure will ensure that the hand grip remains in a firmly locked position during the exercise.

Figure 11:
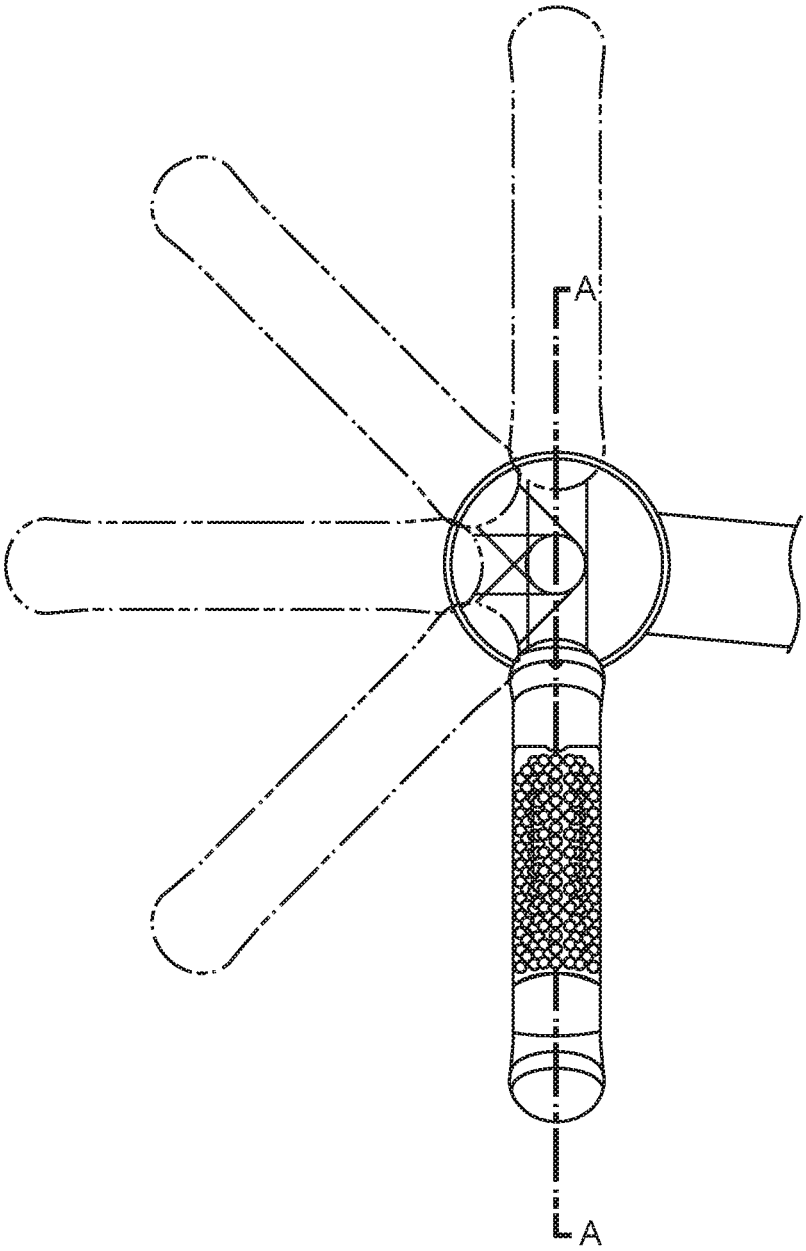
FIG. 11 is an illustration of five different positions for a gripping handle.

Lastly, as seen in FIG. 11, gripping handle 10 can be locked into place at a plurality of different radial positions in a circle that are disposed at 45 degrees to one another (i.e.: corresponding to the positions shown in FIGS. 1A, 2, 3, 4 and 5).

What is claimed is:

1. A gripping handle assembly for an exercise machine, the gripping handle assembly comprising:

a circular bearing housing;

an axial shaft receivable into the circular bearing housing;

a gripping handle extending from the axial shaft, the gripping handle extending at an angle to the axial shaft;

at least one bearing between the axial shaft and the circular bearing housing permitting rotational movement of the axial shaft within the circular bearing housing;

a first engaging mechanism on the axial shaft;

a second engaging mechanism on the circular bearing housing, wherein the first and second engaging mechanisms interlock to prevent rotation of the axial shaft in the circular bearing housing and wherein the first and second engaging mechanisms detach to permit rotation of the axial shaft in the circular bearing housing;

a spring biasing element in the circular bearing housing, the spring biasing element biasing the axial shaft into a locked position, the spring biasing element being displaceable to move the axial shaft into an unlocked position; and wherein the exercise machine is a shoulder press machine and the gripping handle assembly is configured such that a user pushing upwards on the gripping handle urges the axial shaft into the locked position.

2. The gripping handle assembly of claim 1, wherein the axial shaft moves forward into the locked position when the spring biasing element is in a neutral position.

3. The gripping handle assembly of claim 2, wherein the spring biasing element is compressed to move the axial shaft into the unlocked position.

4. The gripping handle assembly of claim 1, wherein the first engaging mechanism is a collar having an indexing tab thereon, and the second engaging mechanism is a plurality of indexing slots on the circular bearing housing, and wherein the indexing tab is receivable into any one of the plurality of indexing slots.

5. The gripping handle assembly of claim 4, wherein the collar wraps around an outside of the circular bearing housing.

6. The gripping handle assembly of claim 1, wherein the first and second engaging mechanisms are configured to detach from one another when a user pushes a knob connected to the gripping handle.

7. The gripping handle assembly of claim 1, wherein the first and second engaging mechanisms are configured to detach from one another when a user pulls the gripping handle out of the circular bearing housing.

8. The gripping handle assembly of claim 1, further comprising padding around the gripping handle.

9. The gripping handle assembly of claim 1, wherein the first and second engaging mechanisms interlock at a plurality of different radial positions in a circle.

10. The gripping handle assembly of claim 9, wherein the plurality of different radial positions in the circle are disposed at 45 degrees relative to one another.

* * * * *